US006786949B2

(12) United States Patent
Marcheze

(10) Patent No.: US 6,786,949 B2
(45) Date of Patent: Sep. 7, 2004

(54) METHOD AND APPARATUS FOR USING A PRE-JEL FOR PRODUCING SELF-REDUCING AGGLOMERATES

(75) Inventor: Edmar Saul Marcheze, Santa Catarina (BR)

(73) Assignee: Startec Iron, LLC, Edina, MN (US)

( * ) Notice: Subject to any disclaimer, the term of this patent is extended or adjusted under 35 U.S.C. 154(b) by 69 days.

(21) Appl. No.: 09/811,429

(22) Filed: Mar. 20, 2001

(65) Prior Publication Data

US 2002/0170388 A1 Nov. 21, 2002

(51) Int. Cl.[7] ..... C22B 1/14; C22B 1/212

(52) U.S. Cl. ..... 75/313; 75/319; 75/321; 75/380; 266/87

(58) Field of Search ..... 75/313, 319, 321, 75/380, 772, 320, 751, 752, 381; 266/87, 177, 178

(56) References Cited

U.S. PATENT DOCUMENTS

| | | | | | |
|---|---|---|---|---|---|
| 3,922,165 | A | * | 11/1975 | Harker et al. | 75/484 |
| 3,957,482 | A | * | 5/1976 | Whigham | 75/369 |
| 4,113,479 | A | * | 9/1978 | Buker | 75/623 |
| 4,316,718 | A | | 2/1982 | Drugge | |
| 4,372,968 | A | * | 2/1983 | Kitamori et al. | 514/474 |
| 4,402,736 | A | | 9/1983 | Graham | |
| 4,410,355 | A | | 10/1983 | Feichtner et al. | |
| 5,294,250 | A | | 3/1994 | Panigraphy et al. | |
| 6,071,325 | A | * | 6/2000 | Schmitt | 75/321 |
| 6,342,089 | B1 | * | 1/2002 | McGaa | 75/319 |
| 6,391,086 | B1 | * | 5/2002 | Contrucci et al. | 75/569 |
| 6,692,688 | B2 | * | 2/2004 | Contrucci et al. | 266/144 |

FOREIGN PATENT DOCUMENTS

| | | |
|---|---|---|
| EP | 0 916 742 | 5/1999 |
| EP | 0 960 952 | 12/1999 |
| GB | 1 434 406 | 5/1976 |

* cited by examiner

*Primary Examiner*—Melvyn Andrews
(74) *Attorney, Agent, or Firm*—Ladas & Parry

(57) ABSTRACT

Self-reducing agglomerates are provided for use in the production of metal. The agglomerates comprise a mixture of iron oxide containing particles and particles of a reducing agent bonded by use of a pre-gel. The agglomerates are produced by a method and apparatus that provides for mixing and curing thereof. The agglomerates may then be used for reduction thereof for the production of iron.

6 Claims, 2 Drawing Sheets

METHOD AND APPARATUS FOR USING A PRE-JEL FOR PRODUCING SELF-REDUCING AGGLOMERATES

BACKGROUND OF THE INVENTION

The present invention relates to self-reducing agglomerates for use in the production of iron, and to methods and apparatus for the production thereof.

The development of iron bearing agglomerates began in the fifties. These agglomerates were mainly in the form of pellets, with the purpose of enabling the use of mineral fines, which the conventional methods, such as those used in blast furnaces, cupola furnaces, electric furnaces and others, could not accept as raw materials due to the fine size thereof, articularly in the case of iron ore. Some time thereafter the development of self-reducing agglomerates began. This development was characterized by the use of cold cure binders, particularly cement, lime and silica, which exhibit as the cure mechanism, mainly reactions with water (hydration) and in lesser amount with the carbon dioxide present in the air (carbonation). Those reactions, although imparting to the agglomerate the desired mechanical properties, are slow reactions, requiring between 10 to 30 days for completion, and sometimes even more depending on the weather conditions (the cure velocity diminishes with the decrease of the ambient temperature).

Some alternatives were developed to accelerate the hydration reactions referred to above, by means of treatment of the agglomerates in pressure vessels (autoclaves) by applying pressures on the order of up to 20 atmospheres and water vapor at 250° C., as recited in U.S. Pat. No. 4,528,029, which is incorporated herein. The major disadvantage of this alternative practice is the high cost of the equipment required and the complex operating conditions, rendering the commercial application thereof difficult.

SUMMARY OF THE INVENTION

The present invention relates to self-reducing agglomerates for use in the production of iron. The agglomerates include a mixture of iron oxide containing particles and particles of a reducing agent. The mixture is bonded by a pre-gel.

The mixture may include particles of a fluxing agent.

The reducing agent may include carbonaceous material.

The iron oxide containing particles may include at least one of iron ore, industrial residue containing iron oxide with or without metallic iron and oxides of metal other than iron.

The method in accordance with the invention for producing the self-reducing agglomerates includes mixing iron oxide containing particles and particles of a reducing agent with a pre-gel. This mixing is performed in an atmosphere of air and addition of 5 to 20% of water to produce the agglomerates. Thereafter, the agglomerates are cured by heating at a temperature of about 100 to 180° C. for about 10 to 60 minutes. Thereafter, the agglomerates are introduced to a reduction chamber for use in the production of iron therefrom.

The apparatus for the continuous production of the agglomerates, in accordance with the invention, includes equipment for conveying the agglomerates, for introducing hot gas to the agglomerates while they are being conveyed, and for controlling the speed of the conveying equipment to expose the agglomerates to the hot gas for about 10 to 60 minutes.

Additional equipment may be provided for uniformly distributing the hot gas to the agglomerates while they are being conveyed.

The conveying equipment may include a perforated belt allowing passage of the hot gas therethrough to the agglomerates.

The method according to the invention may comprise the step of forming the agglomerate in the shape of pellets or briquettes or any other suitable geometric shape.

The method according to the invention may employ fluxing materials, such as lime, limestone, steel plant slag, blast furnace slag and similar materials, to flux the nonmetallic impurities present in the agglomerate.

In the method according to the invention, the pre-gel is added to develop the mechanical properties of the agglomerate, particularly the compression strength thereof, upon curing at temperatures in the range from about 100 to about 180° C.

The equipment according to the invention may include a system for the uniform distribution of hot gasses along the belt.

The equipment according to the invention, the heated gas may comprise air, burned gas, water vapor, inert gas and mixtures thereof without restrictions to proportions.

The equipment according to the invention may comprise a plurality of overlapping belt segments in the same direction or with alternately opposed directions of movement.

The equipment according to the invention may include a uniform exhaust system that does not affect the distribution of the heated gasses through ports distributed along the belt.

The heating of the agglomerates to provide drying and curing may be effected using heated air, burned gas, water vapor, inert gas and mixtures thereof, without restriction in terms of proportions, distributed along the belt to enable the same to pass uniformly through the agglomerates and not interfere with the distribution of the inflow of the heated gas. This avoids the occurrence of preferential gas flow and excessive variation of the uniformity of drying and curing. Hence, the speed of the belt may be constant while providing the required agglomerate residence time for adequate curing.

After the passage of the agglomerates through the curing equipment, the same are ready for use for the metal production.

DETAILED DESCRIPTION OF THE PREFERRED EMBODIMENTS

Figure 1:
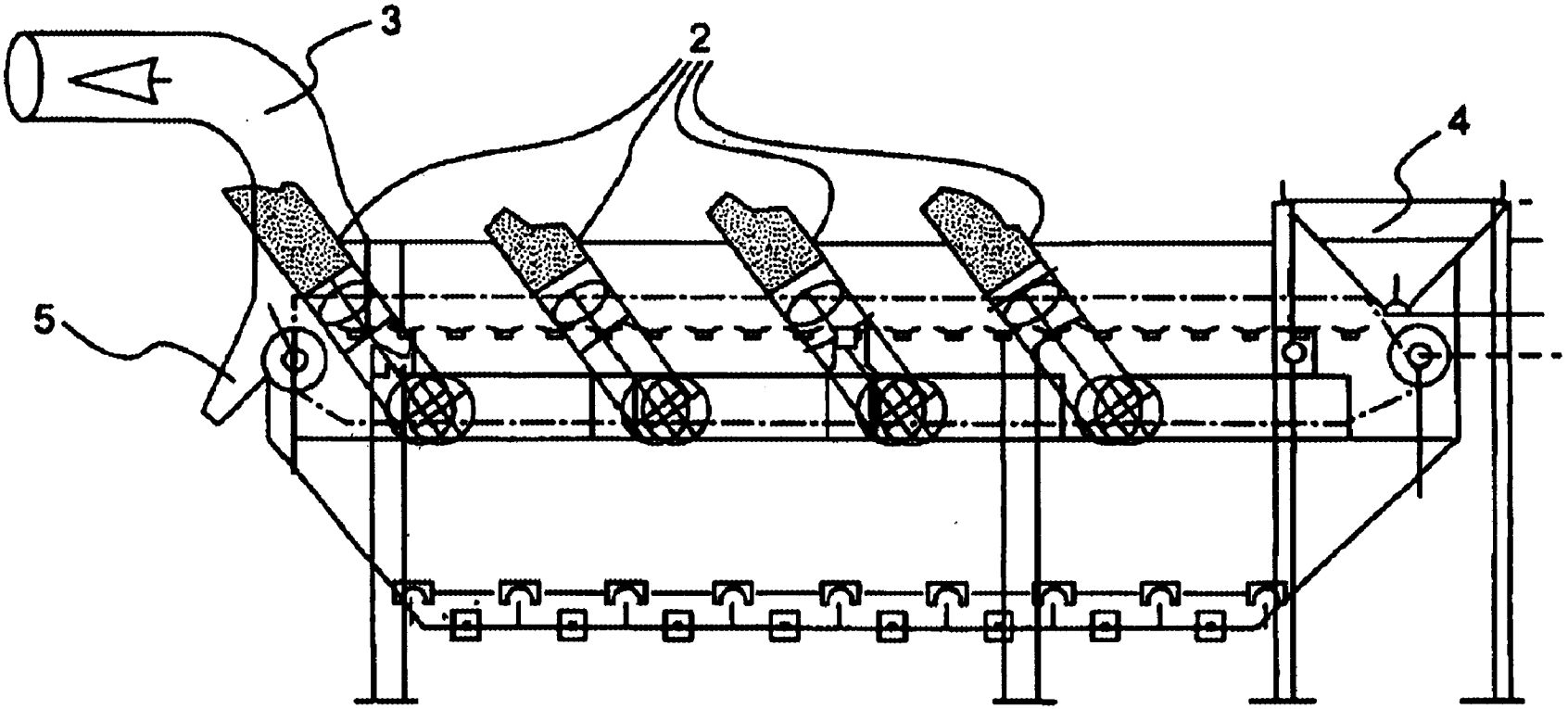
FIG. 1 is a longitudinal section view of one embodiment of equipment in accordance with the invention.
Figure 2:
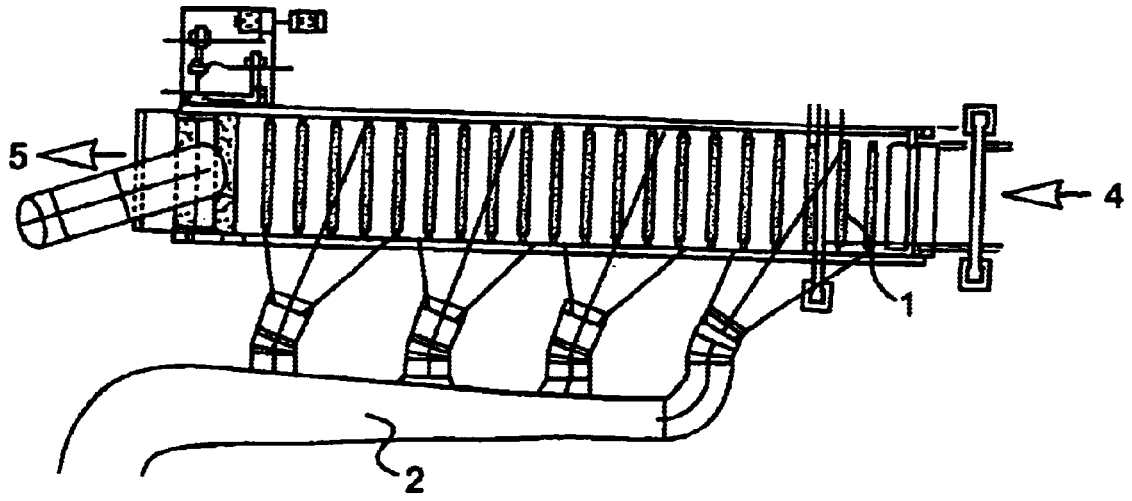
FIG. 2 is a top view of the equipment of FIG. 1.
Figure 3:
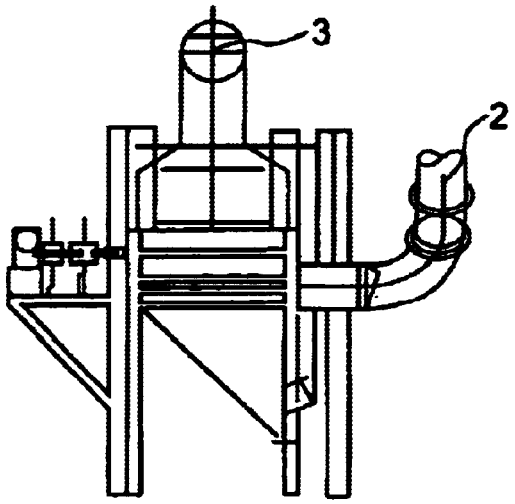
FIG. 3 is a cross sectional view of the equipment of FIG. 1.

The self-reducing agglomerates described herein may be cured and dried in the equipment illustrated in FIGS. 1, 2 and 3. This equipment comprises one or more perforated conveyor belts 1, the speed of which may be controlled to allow an agglomerate residence time between 10 and 60 minutes, more specifically between 20 and 40 minutes. The equipment also has an inlet system 2, for supplying heated gasses at a temperature between 100 and 180° C. It also has an exhaust system 3 for the exhaust of the gasses passing from the agglomerates. One inlet 4 for non-cured agglomerates and at least one outlet 5 for cured and dry agglomerates, which may thereafter be processed in reducing/melting equipment to produce metals.

The equipment described above cures the agglomerates which are then ready for use in a reducing/melting unit.

The pre-gel is a modified starch that, when submitted to temperatures of about 100 to about 180° C. for periods of time between about 10 and about 60 minutes, imparts mechanical properties to the agglomerate, particularly compression strength, at least equivalent to those obtained with the hydraulic cure agglomerates. Additionally, the use of the pre-gel eliminates the need to use specific equipment such as gas pressure vessels, commonly termed as autoclaves.

In accordance with the invention, agglomerates in the form of pellets were produced from a mixture of iron containing material constituting iron ore fines, a reducing agent constituting coal fines and a pre-gel having starch as the major component. Approximately 8% water was added to this mixture to facilitate forming of green pellets. The green pellets were cured by heating for the times at a temperature set forth in Table 1. Upon completion of curing the pellets were tested to determine the cold compression strength thereof by measuring the maximum compressive load on the pellet upon fracture. The results of these tests are set forth in Table 1.

TABLE 1

| Pellet Diameter mm | Curing Temp. ° C. | Curing Time minutes | Pre-gel % | Cold Compression Strength kgf/pellet | Specified Cold Compression Strength kgf/pellet |
|---|---|---|---|---|---|
| 11 | 130 | 60 | 1.0 | 19.46 | >15 |
| 11 | 130 | 60 | 1.5 | 17.77 | >15 |
| 12 | 140 | 30 | 1.5 | 23.54 | >17 |
| 13 | 140 | 30 | 0.8 | 21.86 | >20 |
| 12 | 140 | 60 | 1.0 | 23.0 | >17 |
| 12 | 150 | 60 | 0.8 | 31.16 | >17 |
| 12 | 140 | 30 | 3.0 | 23.97 | >17 |
| 12 | 130 | 0 | 2.5 | 21.96 | >17 |

kgf means kilograms of force.

For purposes of the invention, the pre-gel for use therein is defined as a starch modified by temperature and pressure treatment wherein water is initially added and then removed to gelatinize the starch. The gelatined starch is then ground to fine particle size for use as a binder. The term perforated belt as used therein includes any belt having openings suitable to allow the passage of gas therethrough to the agglomerates on the belt; this would include a belt made of mesh material.

What is claimed is:

1. A method for the production of self-reducing agglomerates for use in the production of metal comprising:

mixing metallic oxide containing particles, and particles of a carbonaceous reducing agent with a pre-gel;

introducing hot gas to said agglomerates at a sequentially decreasing temperature as the moisture content of said agglomerates decreases and the temperature of said agglomerates increases, wherein the temperature of the hot gas introduced to said agglomerates is controlled at a temperature to maintain the agglomerates below the combustion temperature thereof; thereafter curing said agglomerates by heating said agglomerates at a temperature of about 100 to 180° C. for about 10 to 60 minutes; and thereafter introducing said agglomerates to a reduction chamber for the production of methal therefrom.

2. The method of claim 1, wherein said mixture includes particles of a fluxing agent.

3. The method of claim 1, wherein said metallic oxide containing particles include at least one of iron ore, industrial residue containing iron oxide with or without metallic iron, and oxides of metals other than iron.

4. Apparatus for the continuous production of self-reducing agglomerates for use in the production of metal comprising:

means for conveying agglomerates comprising a mixture of metallic oxide containing particles, particles of a carbonaceous reducing agent, and a pre-gel binder;

means for introducing hot gas to said agglomerates while being conveyed on said means for conveying said introducing means including means for sequentially decreasing temperature of said hot gas introduced to said agglomerates as moisture content of said agglomerates decreases and the temperature of the agglomerates increases, wherein the temperature of the hot gas introduced to the agglomerates is controlled at a temperature to maintain the agglomerates is controlled at a temperature to maintain the agglomerates below the combustion temperature thereof; and means for controlling speed of said means for conveying to expose said agglomerates to said hot gas for about 10 to 60 minutes.

5. The apparatus of claim 4, including means for uniformly distributing said hot bas to said agglomerates while being conveyed.

6. The apparatus of claim 5, wherein said means for conveying includes a perforated belt allowing passage of said hot gas therethrough to said agglomerates.

* * * * *